US011067024B2

(12) United States Patent
Madan et al.

(10) Patent No.: US 11,067,024 B2
(45) Date of Patent: Jul. 20, 2021

(54) METHOD FOR REQUIREMENT-BASED SERVICING OF AN INJECTOR

(71) Applicant: MTU FRIEDRICHSHAFEN GMBH, Friedrichshafen (DE)

(72) Inventors: Ion Madan, Tettnang (DE); Michael Mohr, Friedrichshafen-Ailingen (DE); Rolf Pfeifer, Uhldingen-Mühlhofen (DE); Patrick Stöckle, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 16/611,369

(22) PCT Filed: May 2, 2018

(86) PCT No.: PCT/EP2018/061233
§ 371 (c)(1),
(2) Date: Nov. 6, 2019

(87) PCT Pub. No.: WO2018/206368
PCT Pub. Date: Nov. 15, 2018

(65) Prior Publication Data

US 2020/0158043 A1 May 21, 2020

(30) Foreign Application Priority Data

May 8, 2017 (DE) ..... 10 2017 004 424.4

(51) Int. Cl.
*F02D 41/24* (2006.01)
*F02D 41/22* (2006.01)
(Continued)

(52) U.S. Cl.
CPC ..... *F02D 41/2467* (2013.01); *F02D 41/221* (2013.01); *F02D 41/3845* (2013.01);
(Continued)

(58) Field of Classification Search
CPC .... F02D 41/24; F02D 41/2467; F02D 41/224; F02D 41/38; F02D 41/3845; F02D 41/40;
(Continued)

(56) References Cited

U.S. PATENT DOCUMENTS 6,250,285 B1 * 6/2001 Takase ..... F02D 41/221 123/456
7,788,018 B2 8/2010 Speetzen
(Continued)

FOREIGN PATENT DOCUMENTS

DE 102005048532 A1 4/2007
DE 102007037037 B3 2/2009
(Continued)

OTHER PUBLICATIONS

Mario Metzger, Marc Leidenfrost, Ewald Werner, Hermann Riedel, Thomas Seifert: "Lifetime predicton of EN-GJV 450 Cast Iron Cylinder Heads under Combined Thermo-Mechanical and High Cycle Fatigue Loading", SAE 2014-01-9047, Jan. 7, 2014 (Jan. 7, 2014), pp. 1073-1083, XP002783168.
(Continued)

*Primary Examiner* — John Kwon
*Assistant Examiner* — Johnny H Hoang
(74) *Attorney, Agent, or Firm* — Lucas & Mercanti, LLP; Klaus P. Stoffel

(57) ABSTRACT

A method for requirement-based servicing of an injector in a common-rail system in which, during ongoing operation of the engine, a current operating point is stored as a function of the rail pressure and of the fuel injection mass, and the current operating point is multiplied by a damage factor and is stored as a reference injection cycle as a function of the rail pressure as well as of the fuel injection mass. A total reference injection cycle is calculated by forming sums over the reference injection cycles, and a load factor is calculated
(Continued)

as a function of the total reference injection cycle and the permissible injection cycles, and the load factor is set as decisive for the servicing recommendation of the injector.

5 Claims, 4 Drawing Sheets

(51) Int. Cl.
*F02D 41/38* (2006.01)
*F02D 41/40* (2006.01)
*F02M 63/02* (2006.01)

(52) U.S. Cl.
CPC ..... *F02D 41/402* (2013.01); *F02D 2041/224* (2013.01); *F02D 2200/0602* (2013.01); *F02D 2200/0606* (2013.01); *F02D 2200/0614* (2013.01); *F02D 2250/31* (2013.01); *F02M 63/0225* (2013.01)

(58) Field of Classification Search
CPC .. F02D 41/402; F02D 41/248; F02D 2200/06; F02D 2200/0602; F02D 2200/0606; F02D 2200/0614; F02D 2041/224; F02D 2250/31; F02M 63/02; F02M 63/0225
USPC ..... 701/103, 104, 111, 114; 73/114.41, 73/114.48, 114.49, 114.51, 114.45; 123/295, 445–447, 478, 480, 497, 681
See application file for complete search history.

(56) References Cited

U.S. PATENT DOCUMENTS

| | | | | |
|---|---|---|---|---|
| 8,285,471 | B2 | 10/2012 | Sugiyama | |
| 9,416,748 | B2 | 8/2016 | McNulty | |
| 9,909,524 | B2 * | 3/2018 | Golz | F02D 41/402 |
| 9,910,423 | B2 | 3/2018 | Ikeda | |
| 2004/0128055 | A1 * | 7/2004 | Jaliwala | F02D 41/401 701/104 |
| 2009/0043482 | A1 * | 2/2009 | Speetzen | F02D 41/40 701/103 |
| 2014/0283792 | A1 | 9/2014 | Benson | |
| 2016/0237937 | A1 * | 8/2016 | Kusakabe | F02D 41/402 |

FOREIGN PATENT DOCUMENTS

| | | | |
|---|---|---|---|
| DE | 102010017368 | A1 | 12/2010 |
| DE | 102016001920 | A1 | 8/2016 |
| GB | 2534201 | A | 7/2016 |
| JP | H02205992 | A | 8/1990 |
| JP | 2009133253 | A | 6/2009 |

OTHER PUBLICATIONS

Dustin S. Aldridge: "Component and System Life Distribution Prediction Using Weibull and Monte Carlo Analysis with Reliability Demonstration Implications for an Electronic Diesel Injector", SAE 2003-01-1363, Mar. 3, 2003 (Mar. 3, 2003),—Mar. 6, 2003 (Mar. 6, 2003), XP002783169, Detroit, Michigan.

* cited by examiner pCR [bar] →

| qV [mg] ↓ | 600 | 740 | 880 | 1020 | ... | ... | 1510 | 1650 | 1790 | 1930 |
|---|---|---|---|---|---|---|---|---|---|---|
| 30 | 0.05 | 0.15 | 0.34 | 45.76 | | | | | | |
| 90 | | | 0.22 | 1.06 | 1.18 | | | | | |
| 150 | | | | 1.3 | 0.14 | 0.19 | | | | |
| 210 | | | | 0.3 | 0.22 | 0.16 | 0.4 | | | |
| ... | | | | | 0.65 | 0.2 | 0.75 | | | |
| ... | | | | | | 0.7 | 0.17 | | | |
| 420 | | | | | | | 0.1 | 0.37 | | |
| 480 | | | | | | | | 0.01 | 9.71 | |
| 540 | | | | | | | | | 68.32 | |
| 600 | | | | | | | | | | |

EZ(1.4)

EZ(9.9)

11
Injection cycles
EZ

Fig. 2 pCR [bar] →

| qV [mg] ↓ | 600 | 740 | 880 | 1020 | ... | ... | 1510 | 1650 | 1790 | 1930 |
|---|---|---|---|---|---|---|---|---|---|---|
| 30 | 0.01 | 0.15 | 0.25 | 0.3 | | | | | | |
| 90 | | | 0.2 | 0.2 | 0.1 | | | | | |
| 150 | | | | 0 | 0 | 0.1 | | | | |
| 210 | | | | 0.2 | 0 | 0.5 | 0.6 | | 1 | |
| ... | | | | | 0 | 0.2 | 0.7 | 1 | | |
| ... | | | | | | 0.7 | 0.7 | | | |
| 420 | | | | | | | 0.9 | 0.95 | | |

HSF(1.4)

HSF(4.8)

Fig. 3 pCR [bar] →

| qV [mg] ↓ | 600 | 740 | 880 | 1020 | ... | ... | 1510 | 1650 | 1790 | 1930 |
|---|---|---|---|---|---|---|---|---|---|---|
| 30 | 55.13 | 58.63 | 60.58 | 53.54 | | | | | | |
| 90 | | | 58.12 | 55.34 | 54.92 | | | | | |
| 150 | | | | 57.12 | 57.09 | 58.32 | | | | |
| 210 | | | | 64.12 | 60.43 | 54.57 | 58.57 | | | |
| ... | | | | | 63.02 | 62.24 | 60.58 | | | |
| ... | | | | | | 63.16 | 65.91 | | | |
| 420 | | | | | | | 66.95 | 66.83 | | |
| 480 | | | | | | | | 68.70 | | |
| 540 | | | | | | | | | 71.28 | |
| 600 | | | | | | | | | | |

TKR(1.4)

TKR(9/9)

13
Fuel temperature
TKR

Fig. 4 pCR [bar] →

| qV [mg] ↓ | 600 | 740 | 880 | 1020 | ... | ... | 1510 | 1650 | 1790 | 1930 |
|---|---|---|---|---|---|---|---|---|---|---|
| 30 | 0.01 | 0.02 | 0.08 | 13.72 | | | | | | |
| 90 | | | 0.04 | 0.21 | 0.11 | | | | | |
| 150 | | | | 0 | 0 | 0.1 | | | | |
| 210 | | | | 0.06 | 0 | 0.08 | 0.02 | | | |
| ... | | | | | 0 | 0.04 | 0.52 | | | |
| ... | | | | | | 0.05 | 0.01 | | | |

REZ(1.4)

Fig. 5

METHOD FOR REQUIREMENT-BASED SERVICING OF AN INJECTOR

CROSS-REFERENCE TO RELATED APPLICATIONS

The present application is a 371 of International application PCT/EP2018/061233, filed May 2, 2018, which claims priority of DE 10 2017 004 424.4, filed May 8, 2017, the priority of these applications is hereby claimed and these applications are incorporated herein by reference.

BACKGROUND OF THE INVENTION

The invention relates to a method for requirement-based servicing of an injector in a common rail system in which a load factor is calculated and is set as decisive for the servicing recommendation of the injector.

DE 10 2005 048 532 A1 discloses a method for monitoring the mechanical components of a drive engine in a vehicle in which in a first step the operating data of the component are acquired as a load spectrum, and a characteristic variable of the component is ascertained in a second step. If there is a risk of a fault in the component, in a third step the loading of the component is reduced or limited, which is intended to prevent the vehicle being immobilized for a short time. In addition, the driver is informed about the risk of a fault, and the predicted residual running time is displayed.

U.S. Pat. No. 9,416,748 B2 discloses a method for monitoring an injector in which a coking factor is calculated on the basis of the residence time in the rotational speed classes and torque classes. The injection period is then correspondingly adapted on the basis of the coking factor, which is intended to permit the exhaust gas limiting values to be complied with.

SUMMARY OF THE INVENTION

Taking the prior art described above as a basis, the invention is based on the object of developing a method for requirement-based servicing of an injector.

This object is achieved by a method in which, during ongoing operation of the engine, a current operating point is first stored as a function of the rail pressure and of the fuel injection mass, said current operating point is then multiplied by a damage factor and is subsequently stored as a reference injection cycle as a function of the rail pressure and of the fuel injection mass. The damage factor describes the hydrodynamic loading of the common rail system. The damage factor is read out from a damage factor characteristic diagram as a function of the rail pressure and of the fuel injection mass. The damage factor can also optionally be weighted on the basis of the fuel temperature. After the calculation of the reference injection cycles, the sum thereof is calculated and stored as a total reference injection cycle. A load factor is then in turn determined from the total reference injection cycle and the maximum permissible injection cycles by forming quotients, which load factor is set as decisive for the servicing recommendation of the injector. Finally, a comparison of the load factor with a limiting value defines whether either a servicing recommendation to replace the injector is generated or whether a residual running time, within which non-problematic further operation is possible, is predicted.

For the end customer, the invention provides the advantage of even further improved transparency in that the assignment of individual ways of behaving and servicing intervals or servicing costs is indicated. For example also in that the end customer can access the current operating data by means of an app. The invention provides the advantage both for the manufacturer of the internal combustion engine as well as for the end customer that a service technician can be dispatched even before the expiry of the maximum service life of the injector. However, if an injector fails, thanks to the invention a history which can be tracked uninterruptedly can be retrieved. Likewise, the data can be used as a basis for the re-development of an injector.

BRIEF DESCRIPTION OF THE DRAWING

A preferred exemplary embodiment is illustrated in the figures, in which:

FIG. 2 shows a characteristic diagram of the injection cycles,

FIG. 3 shows a characteristic diagram of the damage factor,

FIG. 4 shows a characteristic diagram of the fuel temperature,

FIG. 5 shows a characteristic diagram of the reference injection cycle and

DETAILED DESCRIPTION OF THE INVENTION

Figure 1:
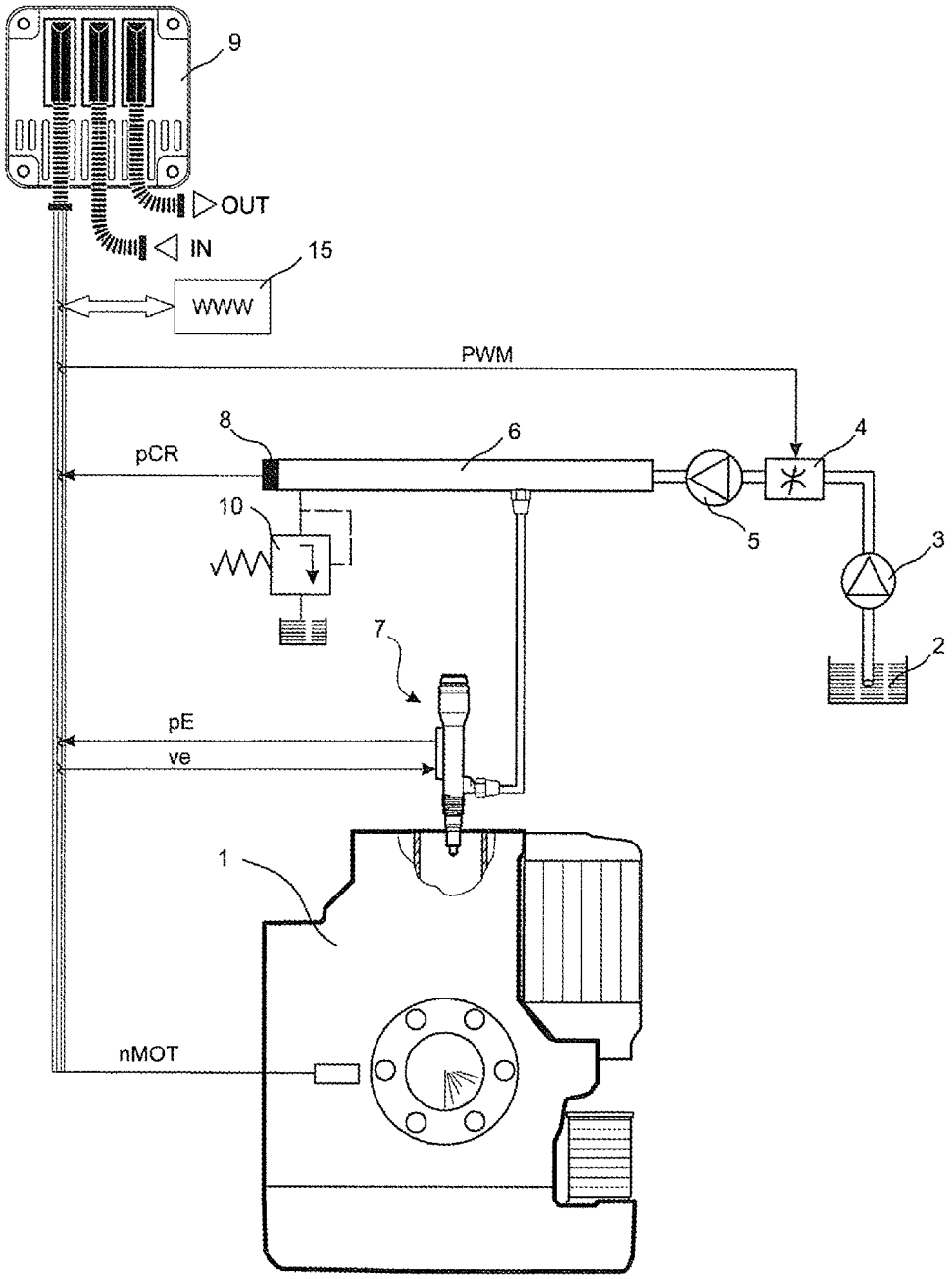
FIG. 1 shows a system diagram.

FIG. 1 shows a system diagram of an electronically controlled internal combustion engine 1 with a common rail system. The common rail system comprises the following mechanical components: a low-pressure pump 3 for feeding fuel from a fuel tank 2, a variable intake throttle 4 for influencing the volume of fuel flowing through, a high-pressure pump 5 for feeding the fuel under increased pressure, a rail 6 for storing the fuel and injectors 7 for injecting the fuel into the combustion chambers of the internal combustion engine 1. The common rail system can also optionally be embodied with individual accumulators, wherein then, for example, an individual accumulator is integrated as an additional buffer volume for the fuel in the injector 7. A passive pressure limiting valve 10 is provided as protection against an inadmissibly high pressure level in the rail 6, which pressure limiting valve 10 opens, for example, at a rail pressure of 2400 bar, and in the opened state diverts the fuel from the rail 6 into the fuel tank 2.

The mode of operation of the internal combustion engine 1 is determined by an electronic engine control unit 9 which includes the customary components of a microcomputer system, for example a microprocessor, I/O modules, buffers and storage modules (EEPROM, RAM). The operating data which are relevant for the operation of the internal combustion engine 1 are applied in characteristic diagrams/characteristic curves in the memory modules. The electronic engine control unit 9 uses these to calculate the output variables from the input variables. FIG. 1 illustrates the following input variables by way of example: the rail pressure pCR, which is measured by means of a rail pressure sensor 8, an engine rotational speed nMOT, optionally the individual accumulator pressure pE and an input variable EIN. The term input variable EIN includes the further signals, for example a signal with a specification of the power by the operator, and the charge air pressure of an exhaust gas turbocharger. FIG. 1 illustrates, as output variables of the electronic control unit 9, a signal PWM for actuating the intake throttle 4, a signal ve for actuating the injectors 7 (start/end of injection) and an output variable AUS. The output variable AUS is representative of the further actuation signals for performing open-loop and closed-loop control of the internal combustion engine 1, for example for an actuation signal for activating a second exhaust gas turbocharger in the case of sequential turbocharging. Via this interface 15, the manufacturer of the internal combustion engine can read out data and, when necessary, react early by dispatching a service technician. Likewise, the operator can access the current operating data.

FIG. 2 shows a characteristic diagram 11 of the injection cycles EZ. A plurality of exemplary operating points of the injection cycles EZ are illustrated in the characteristic diagram 11 as a function of the rail pressure pCR and of the fuel injection mass qV. In practice, this characteristic diagram can be embodied as a 20 times 20 matrix. For reasons of better clarity, the injection cycles are standardized to a million injection cycles. Therefore, for example the operating point EZ(1/4) is defined by a rail pressure pCR=1020 bar and a fuel injection mass qV=30 mg (milligrams). The operating point itself has the value 46.76 times one million injection cycles. The point EZ(9/9) has the highest value, specifically 68.32, within the characteristic diagram. In other words: the characteristic diagram 11 represents a load spectrum of the frequency of an operating point within the rail pressure injection mass classes.

FIG. 3 shows a characteristic diagram 12 of the damage factor HSF. The damage factor HSF describes the hydrodynamic loading on the common rail system. The characteristic diagram 12 shows the same reference points of the rail pressure pCR and of the fuel injection mass qV as the characteristic diagram 11 of the injection cycles EZ. In practice, the characteristic diagram 12 is therefore also embodied as a 20 times 20 matrix. Values of the damage factor HSF are illustrated within the characteristic diagram 12. The highest value within the characteristic diagram 12 is occupied by the number 1. This value corresponds to the critical operating point with the highest intensity of wear, here the point HSF(4/8) with a rail pressure pCR=1790 bar and a fuel injection mass qV=210 mg. The reference points HSF(1/4) and HSF(9/9) correspond to the two points EZ(1/4) and EZ(9/9) of the characteristic diagram 11. The characteristic diagram 12 is populated either with the data from back-measured field engines or with data from a test stand run. The further description is provided in conjunction with FIG. 4 in which a characteristic diagram 13 of the fuel temperature TKR is illustrated. The characteristic diagram 13 is provided as an option, wherein a relatively high fuel temperature brings about qualitatively a relatively large amount of damage. The values of the damage factor HSF are weighted by means of the characteristic diagram 13. The characteristic diagram 13 therefore has the same reference points as the characteristic diagrams 11 and 12. Therefore, for example the reference point TKR(1/4) corresponds to the reference point EZ(1/4) in the characteristic diagram 11 and to the reference point HSF(1/4) in the characteristic diagram 12. The fuel temperatures are illustrated in OC within the characteristic diagram 13.

Figure 6:
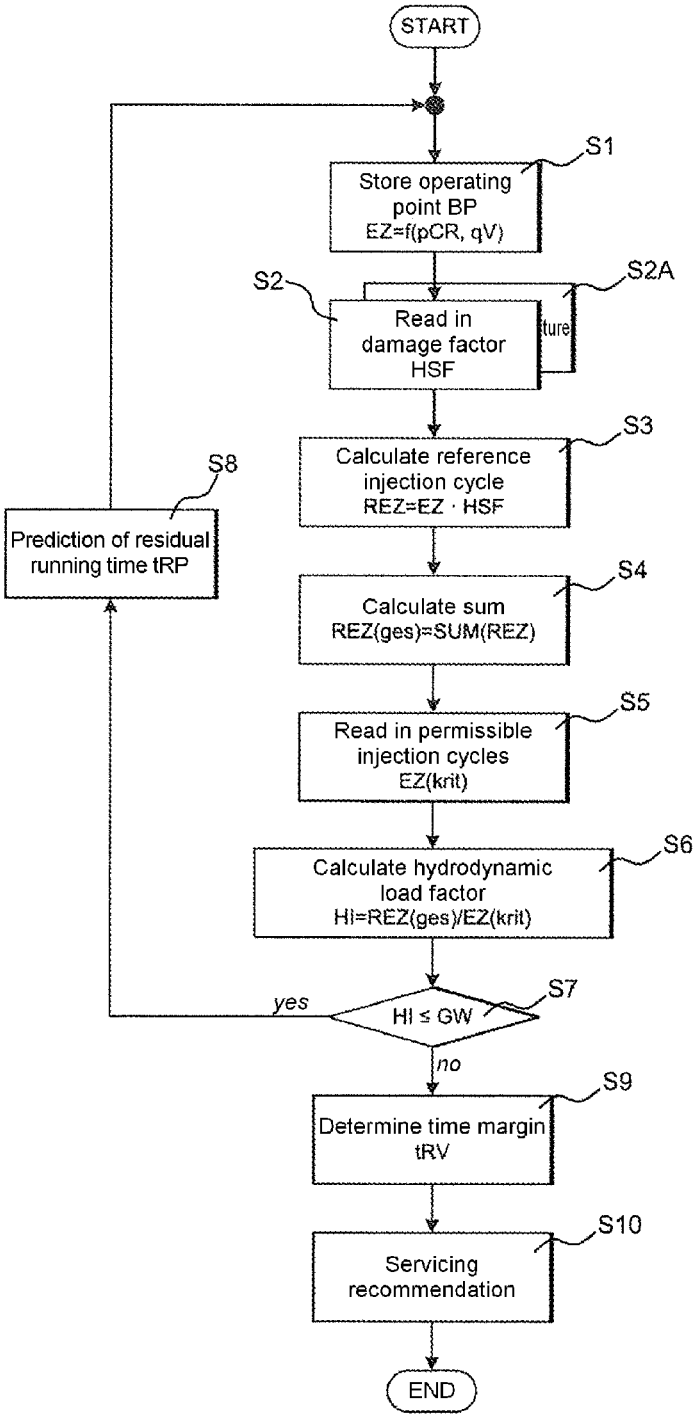
FIG. 6 shows a program sequence diagram.

The further description applies jointly to FIGS. 5 and 6, wherein in FIG. 5 the characteristic diagram 14 of the reference injection cycles REZ, and in FIG. 6 the method are illustrated as a program sequence diagram. In S1, the current operating point BP is stored in the characteristic diagram 11 of the injection cycles EZ as a function of the rail pressure pCR and of the fuel injection mass qV, for example as EZ(9/9). Then, at S2 the damage factor HSF which corresponds to this is read out from the characteristic diagram 12, that is to say the reference point HSF(9/9). This reference point can optionally also be weighted by means of the fuel temperature, step S2A. At S3, the reference injection cycle REZ is then calculated by multiplying the current operating point BP by the damage factor HSF. The value of the reference injection cycle REZ(9/9) in FIG. 5 is consequently calculated from the value of EZ(9/9), value: 68.32 times one million, multiplied by the value of HSF(9/9), value: 0.8, to yield 54.65 times one million injection cycles. The further values of the reference injection cycles of the characteristic diagram 14 are calculated in an analogous fashion. Subsequently, at S4 a total reference injection cycle REZ(ges) is calculated by forming sums of the reference injection cycles REZ. At S5, the maximum number of injection cycles EZ(krit) is read in. The maximum number is determined at the manufacturer of the injection combustion engine from trials on a component test bench. An exemplary value of the maximum permissible injection cycles is EZ(krit)=100 million injection cycles, which corresponds to a total service life of the injector of 8900 hours. At S6, a load factor HI is calculated by forming quotients from the total reference injection cycle REZ(ges) and the maximum number of injection cycles EZ(krit). The load factor corresponds to the hydrodynamic loading of the injector. Then, at S7 it is tested whether the load factor HI is less than or equal to a limiting value GW, for example GW1≥1. If this is the case, interrogation result S7: yes, at S8 a residual running time tRP is predicted for non-problematic further operation of the internal combustion engine, and the program sequence is continued at S1. If the result of the testing at S7 is that the load factor HI is higher than the limiting value GW, interrogation result S7: no, the load factor HI is set as decisive for the servicing recommendation to replace the injector. For this purpose, at S9 a time margin tRV for the still remaining further operation is calculated. Subsequently at S10 a servicing recommendation is output to the operator, wherein the servicing recommendation indicates replacement of all the injectors of the internal combustion engine. Therefore, the program sequence diagram is then ended.

LIST OF REFERENCE NUMBERS

1 Internal combustion engine
2 Fuel tank
3 Low-pressure pump
4 Intake throttle
5 High-pressure pump
6 Rail
7 Injector
8 Rail pressure sensor
9 Electronic engine control unit
10 Pressure limiting valve
11 Characteristic diagram of injection cycles (EZ)
12 Characteristic diagram of damage factor (HSF)
13 Characteristic diagram of fuel temperature (TKR)
14 Characteristic diagram of reference injection cycles (REZ)
15 Interface

The invention claimed is:

1. A method for requirement-based servicing of an injector in a common rail system of an engine, comprising the steps of:

a) providing a first characteristic diagram of injection cycles, which contains reference points that represent a load spectrum of a frequency of an operating point within rail pressure-injection mass classes, each of the reference points being a value representing a number of injection cycles as a function of rail pressure and fuel injection mass during operation of the engine;

b) providing a second characteristic diagram for a damage factor that describes hydrodynamic loading on the common rail system, the second characteristic diagram being pre-populated, the second characteristic diagram having the same reference points of the rail pressure and to the fuel injection mass as the first characteristic diagram;

c) determining a current operating point by measuring the rail pressure and the fuel engine mass and locating a corresponding reference point value on the first characteristic diagram;

d) reading out a reference point value from the second characteristic diagram that corresponds to the reference point on the first characteristic diagram;

e) calculating a reference injection cycle value by multiplying the reference point value of the current operating point by the corresponding reference point value from the second characteristic diagram to provide a corresponding reference point saved on a third characteristic diagram of reference injection cycles as a function of the rail pressure and the fuel injection mass;

f) repeating steps c)-e) to complete the third characteristic diagram;

g) calculating a total reference injection cycle value by adding up the reference injection cycle values;

h) calculating a load factor by dividing the total reference injection cycle value by a predetermined value of permitted injection cycles; and i) setting the load factor as decisive for a servicing recommendation of the injector.

2. The method according to claim 1, further including comparing the load factor with a limiting value, and calculating a remaining time margin and generating a servicing recommendation to replace the injector when the limiting value is exceeded.

3. The method according to claim 2, including predicting a remaining running time for continued operation when the limiting value is undershot.

4. The method according to claim 1, wherein the damage factor is additionally weighted as a function of fuel temperature.

5. The method according to claim 1, wherein the damage factor characteristic diagram is populated with data from back-measured field engines.

* * * * *